US008970097B2

(12) United States Patent
Yamada et al.

(10) Patent No.: US 8,970,097 B2
(45) Date of Patent: Mar. 3, 2015

(54) SPARK PLUG FOR INTERNAL COMBUSTION ENGINE

(75) Inventors: Yuichi Yamada, Aichi (JP); Hiroaki Kuki, Aichi (JP); Ryuma Kawachi, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 257 days.

(21) Appl. No.: 13/138,198

(22) PCT Filed: Jan. 21, 2010

(86) PCT No.: PCT/JP2010/050683

§ 371 (c)(1), (2), (4) Date: Jul. 19, 2011

(87) PCT Pub. No.: WO2010/084904

PCT Pub. Date: Jul. 29, 2010

(65) Prior Publication Data

US 2011/0273074 A1 Nov. 10, 2011

(30) Foreign Application Priority Data

Jan. 23, 2009 (JP) ..... 2009-012898
Mar. 27, 2009 (JP) ..... 2009-078146

(51) Int. Cl.
*H01T 13/04* (2006.01)
*H01T 13/08* (2006.01)

(52) U.S. Cl.
CPC ..... *H01T 13/08* (2013.01)
USPC ..... 313/135; 313/118

(58) Field of Classification Search
USPC ..... 313/118–145
See application file for complete search history.

(56) References Cited

U.S. PATENT DOCUMENTS

| | | | | |
|---|---|---|---|---|
| 6,548,945 | B1 * | 4/2003 | Tamura | 313/141 |
| 6,768,249 | B1 * | 7/2004 | Nasu et al. | 313/118 |
| 7,559,312 | B2 | 7/2009 | Brauneis et al. | 123/470 |
| 8,237,343 | B2 | 8/2012 | Hotta et al. | 313/143 |
| 2005/0127808 | A1 * | 6/2005 | Suzuki et al. | 313/118 |
| 2005/0284454 | A1 | 12/2005 | Iwami et al. | 123/635 |
| 2006/0284535 | A1 * | 12/2006 | Ozeki et al. | 313/143 |
| 2007/0210688 | A1 | 9/2007 | Suzuki et al. | 313/141 |
| 2008/0092838 | A1 | 4/2008 | Takeuchi et al. | 123/169 |

FOREIGN PATENT DOCUMENTS

| | | | |
|---|---|---|---|
| CN | 201072845 Y | 6/2008 | H01T 13/20 |
| CN | 101248564 | 8/2008 | F02P 13/00 |
| EP | 1931002 A1 | 8/2006 | H01T 13/36 |
| JE | 2006-9783 | 1/2006 | F02P 13/00 |
| JP | 55-065795 | 5/1980 | |
| JP | 59-130391 | 9/1984 | H01T 13/08 |

(Continued)

OTHER PUBLICATIONS

Notification of Reasons for Refusal (Office Action) from corresponding Japanese Patent App. No. 2010-519039, dispatched on Sep. 4, 2012; 7 pages (includes English translation).

(Continued)

*Primary Examiner* — Anh Mai
*Assistant Examiner* — Zachary J Snyder
(74) *Attorney, Agent, or Firm* — Kusner & Jaffe

(57) ABSTRACT

A spark plug for an internal combustion engine capable of ensuring sufficient gastightness of a combustion chamber and meeting demand for a reduction in diameter.

7 Claims, 12 Drawing Sheets

(56) References Cited

FOREIGN PATENT DOCUMENTS

| | | | | |
|---|---|---|---|---|
| JP | 61-39880 | | 3/1986 | ..... H01T 13/16 |
| JP | 2001-118659 | | 4/2001 | ..... H01T 13/16 |
| JP | 2007-208942 | | 8/2007 | ..... H04N 9/455 |
| JP | 2008-108478 | | 5/2008 | ..... H01T 13/02 |
| JP | 2008-530427 | A | 8/2008 | ..... F02M 61/16 |
| WO | WO 2007/023790 | A1 | 3/2007 | ..... H01T 13/36 |

OTHER PUBLICATIONS

Notification of Reasons for Refusal (Office Action) from corresponding Japanese Patent App. No. 2010-141283, dispatched on Jan. 24, 2012; 9 pages (includes English translation).

Notification of Reasons for Refusal (Office Action) from corresponding Japanese Patent App. No. 2010-519039, dispatched on Feb. 19, 2013; 6 pages (includes English translation).

Form PCT/ISA/210—Int'l Search Report (from corresponding Int'l Patent App. No. PCT/JP2010/050683—English version only); 4 pages.

Notification of the Second Office Action from corresponding Chinese Patent App. No. 201080003648, issued on Jun. 25, 2013; 16 pages (includes English translation).

Office Action received in corresponding Chinese Patent Application No. 201310049122.5 dated Jun. 3, 2014 (English-language translation included).

* cited by examiner

SPARK PLUG FOR INTERNAL COMBUSTION ENGINE

FIELD OF THE INVENTION

The present invention relates to a spark plug for use in an internal combustion engine.

BACKGROUND OF THE INVENTION

A spark plug is mounted to an internal combustion engine and used to ignite air-fuel mixture in a combustion chamber. Generally, a spark plug includes an insulator having an axial hole extending in the direction of an axis, a center electrode inserted into the axial hole, and a metallic shell provided externally of the outer circumference of the insulator. The metallic shell has, on its outer circumferential surface, a threaded portion that is dimensioned to threadingly engage with a mounting hole of a head of the internal combustion engine. A screw neck extends rearward from the rear end of the threaded portion. A diameter-expanded portion is located rearward of the screw neck and has a diameter greater than that of the screw neck. A seat portion connectingly extends between the screw neck and the diameter-expanded portion. Additionally, a ring-like gasket is provided around the screw neck in contact with the seat portion. When the spark plug is mounted to the internal combustion engine, an axial force associated with screw engagement brings the gasket into close contact with the head of the internal combustion engine, thereby maintaining gas tightness (See, for example, Japanese Patent Application Laid-Open (kokai) No. 2008-108478).

In view of implementation of further improved gastightness, bringing the seat portion and the head directly into close contact with each other without provision of the gasket is conceived (See, for example, Japanese Patent Application Laid-Open (kokai) No. 2011-118659).

However, spark plugs of such a type may encounter impairment in gastightness caused by occurrence of slight damage, strain, or the like on the seat or the head.

In recent years, in order to improve layout flexibility for an engine head (or for a like purpose) a reduction in the size (diameter) of a spark plug is required, leading to a reduction in the diameter of the diameter-expanded portion and the threaded portion of the metallic shell. A reduction in the diameter of the diameter-expanded portion inevitably leads to a reduction in the area of the seat portion. Also, a reduction in the diameter of the threaded portion may lead to a reduction in an axial force associated with screw engagement. That is, a diameter-reduced spark plug encounters difficulty in ensuring a sufficient seal between the seat portion and the head. Eventually, the gastightness of a combustion chamber is apt to be impaired.

The present invention has been conceived in view of the above circumstances, and provides a spark plug for an internal combustion engine capable of ensuring sufficient gastightness of a combustion chamber and meeting demand for a reduction in diameter.

SUMMARY OF THE INVENTION

Configurations suitable for solving the above problems will next be described in itemized form. If needed, actions and effects peculiar to the configurations will be additionally described.

Configuration 1. In accordance with the present invention, there is provided a spark plug for an internal combustion engine comprised of a rod-like center electrode extending in a direction of an axis. A substantially cylindrical insulator is provided externally of an outer circumference of the center electrode. A substantially cylindrical metallic shell is provided externally of an outer circumference of the insulator. A ground electrode extends from a front end portion of the metallic shell and defines, in cooperation with the center electrode, a gap between a distal end portion thereof and a front end portion of the center electrode. The metallic shell has, on an outer circumferential surface thereof, a threaded portion dimensioned to threadingly engage with a mounting hole of a head of an internal combustion engine. A screw neck is located rearward of the threaded portion. A diameter-expanded portion is located rearward of the screw neck and has a diameter greater than the screw neck. A seat portion located between the screw neck and the diameter-expanded portion. At the time of the threaded portion being threadingly engaged with the mounting hole of the head of the internal combustion engine, the seat portion comes in close contact with the head. The spark plug is characterized in that the threaded portion has a thread diameter of M14, and the seat portion has a Vickers hardness of 250 Hv or less and is higher in hardness than a portion of the head which comes into contact with the seat portion.

According to configuration 1 mentioned above, the seat portion is higher in hardness than a portion of the head which comes into contact with the seat portion. Therefore, even when mounting and demounting the spark plug to and from the head or a like operation is performed a plurality of times, plastic deformation of the seat portion associated with contact of the seat portion with the head can be effectively prevented. Also, since a region of the seat portion which comes into contact with the head has a Vickers hardness of 250 Hv or less, even when mounting and demounting the spark plug (or when a like operation is performed) a plurality of times, deformation of the head is unlikely to occur.

Thus, the present configuration 1 can reliably prevent occurrence of damage, strain, or the like on the seat portion and the head, which are important components with regard to ensuring of gastightness. As a result, a more reliable seal can be provided between the seat portion and the head, and, in turn, a combustion chamber can enjoy excellent gastightness.

The technical concept mentioned above may be embodied in a mounting structure in which a spark plug for an internal combustion engine is mounted to the head of the internal combustion engine.

Configuration 2. In accordance with a second aspect of the present invention, there is provided a spark plug for an internal combustion engine of the present configuration, characterized in that, in configuration 1 mentioned above, the threaded portion has a thread diameter of M12 or less, and the seat portion has a Vickers hardness of 200 Hv or less.

When the thread diameter of the threaded portion is reduced, in view of strength of the threaded portion, reducing a tightening torque for mounting a spark plug to an internal combustion engine is inevitable. However, reducing the tightening torque leads to a reduction in axial force. Thus, close contact of the seat portion with the head becomes insufficient, potentially resulting in impairment in gastightness of a combustion chamber. Also, when the thread diameter of the threaded portion is reduced, the head is more likely to be deformed when mounting and demounting a spark plug or a like operation is performed a plurality of times.

An impairment in gastightness is more likely to arise in a spark plug whose threaded portion has a reduced thread diameter of M12 or less as in the case of configuration 2 mentioned above. However, according to the present configuration 2, a Vickers hardness of 200 Hv or less is specified for a region of the seat portion which comes into contact with the head. Therefore, the seat portion can be more reliably brought into close contact with the head, whereby a more reliable seal can be provided between the seat portion and the head. Also, when mounting and demounting the spark plug or a like operation is performed a plurality of times, deformation of the head can be more reliably prevented. As a result, excellent gastightness of a combustion chamber can be ensured.

Configuration 3. In accordance with a third aspect of the present invention, there is provided a spark plug for an internal combustion engine characterized in that, in configurations 1 or 2 mentioned above, the seat portion has a ten-point height of irregularities of 12.5 μm or less as measured on a surface thereof which comes into contact with the head.

Configuration 3 mentioned above specifies a ten-point height of irregularities of 12.5 μm or less for a surface of the seat portion which comes into contact with the head. Therefore, the seat portion can be more reliably brought into close contact with the head, whereby gastightness of a combustion chamber can be further improved.

Configuration 4. In accordance with a fourth aspect of the present invention, there is provided a spark plug for an internal combustion engine characterized in that, in any one of configurations 1 to 3 mentioned above, the metallic shell has, on an outer circumferential surface thereof, a connection portion which connects a front end of the seat portion and a rear end of the screw neck and forms, with the axis, an angle greater than an angle between the seat portion and the axis as viewed on a section which contains the axis, and, the following expressions (1) and (2) are satisfied.

$$(C-B)/2 \geq 0.3 \text{ mm} \quad (1)$$

$$(A-C)/2 \geq 0.7 \text{ mm} \quad (2),$$

where "A" represents an outside diameter of the diameter-expanded portion, represents a smallest outside diameter of the screw neck, and "C" represents an outside diameter of a boundary between the seat portion and the connection portion.

In the case where the seat portion has a relatively large area, in order to bring the seat portion into close contact with the head, a tightening force for mounting a spark plug must be further increased. However, in the case of a diameter-reduced spark plug or the like, the tightening force must be further reduced. In other words, the tightening force cannot be easily increased.

In view of this, configuration 4 mentioned above is such that only the seat portion comes in close contact with the head without the connection portion coming into contact with the head. By virtue of this, as compared with the case where the entire region which corresponds to the seat portion and the connection portion is brought into close contact with the head, the area of close contact with the head can be reduced. As a result, the spark plug (seat portion) can be more reliably brought into close contact with the head without need to increase a tightening force for mounting the spark plug, whereby excellent gastightness of a combustion chamber can be more easily achieved.

In the case of $(C-B)/2<0.3$ mm; i.e., in the case where the area of the connection portion is reduced relatively, the area of the seat portion inevitably increases, potentially resulting in a failure to sufficiently yield the actions and effects mentioned above. Meanwhile, in the case of $(A-C)/2<0.7$ mm; i.e., in the case where the area of the seat portion is excessively reduced, even though the seat portion is firmly brought into close contact with the head, a seal between the seat portion and the head becomes insufficient, potentially resulting in an impairment in gastightness of a combustion chamber.

Configuration 4 mentioned above is useful particularly in application to a spark plug in which, while the thread diameter is reduced to M12 or less, a region corresponding to the seat portion and the connection portion has a relatively large area. That is, even when the threaded portion is reduced in diameter, a tool engagement portion may not be able to be reduced in size because of a tool to be used or a like reason, and, eventually, the diameter-expanded portion may not be able to be reduced in diameter in accordance with the threaded portion. In such a case, while the region corresponding to the seat portion and the connection portion increases in area, a tightening force must be reduced in association with a reduction in diameter of the threaded portion. That is, while the threaded portion is reduced in diameter to M12 or less, a spark plug in which the region corresponding to the seat portion and the connection portion is increased in area encounters great difficulty in ensuring gastightness of a combustion chamber. In this regard, configuration 4 as described above allows a region which comes in close contact with the head to be reduced in area as mentioned above. Therefore, even though a relatively small tightening force is employed for mounting a diameter-reduced spark plug, a sufficient seal between the seat portion and the head can be ensured.

Configuration 5. In accordance with a fifth aspect of the present invention, there is provided a spark plug for an internal combustion engine characterized in that, in configuration 4 mentioned above, the angle between the seat portion and the axis (as viewed on the section which contains the axis) is 60 degrees to 70 degrees inclusive.

According to configuration 5 mentioned above, since the angle between the seat portion and the axis (seat-portion angle) is specified to be 60° or greater, biting of the seat portion into the head can be prevented. Thus, even when mounting and demounting the spark plug is performed a plurality of times, excellent gastightness can be ensured. Meanwhile, since the seat-portion angle is specified to be 70° or less, contact of the seat portion with the head can be sufficiently improved, whereby excellent gastightness can be implemented.

Configuration 6. In accordance with a sixth aspect of the present invention, there is provided a spark plug for an internal combustion engine comprised of a rod-like center electrode extending in a direction of an axis. A substantially cylindrical insulator is provided externally of an outer circumference of the center electrode, and a substantially cylindrical metallic shell is provided externally of an outer circumference of the insulator. A ground electrode extends from a front end portion of the metallic shell and defines, in cooperation with the center electrode, a gap between a distal end portion thereof and a front end portion of the center electrode. The metallic shell has, on an outer circumferential surface thereof, a threaded portion dimensioned to threadingly engage with a mounting hole of a head of an internal combustion engine. A screw neck is located rearward of the threaded portion. A diameter-expanded portion is located rearward of the screw neck and has a diameter greater than a diameter of the screw neck. A seat portion is located between the screw neck and the diameter-expanded portion. The spark plug is characterized in that a coating layer covers a surface of the seat portion and comes in close contact with the head when the threaded portion is threadingly engaged with the mounting hole of the head of the internal combustion engine. The coating layer is formed of a material having a softening point of 200° C. or higher and lower in hardness than a portion of the head which comes into contact with the coating layer.

According to configuration 6 mentioned above, the coating layer is lower in hardness than a portion of the head which comes into contact with the coating layer. Thus, the coating layer can be more reliably brought into close contact with the head, and occurrence of damage on the head can be more reliably restrained. Also, since the material used to form the coating layer has a softening point of 200° C. or higher, thermal deformation of the coating layer can be restrained in a high-temperature environment in which the spark plug is used. That is, the present configuration 6 can ensure sufficient gastightness of a combustion chamber by virtue of the actions and effects mentioned above.

Examples of a material used to form the coating layer include heat-resistant rubber (fluororubber, etc.), heat-resistant resin (polyamide resin, polyimide resin, fluororesin, polyester resin represented by polyethylene terephthalate (PET), etc.), and a metal material such as zinc. Among these materials, elastically deformable ones are particularly preferred, since, even when the spark plug is mounted to and demounted from the head a plurality of times, deformation of the coating layer can be prevented.

In a spark plug having the connection portion as in the case of configurations 4 and 5 mentioned above, the technical concept of the present configuration 6 may be applied such that the surface of at least the seat portion in a region consisting of the seat portion and the connection portion is covered with the coating layer.

Configuration 7. In accordance with a seventh aspect of the present invention, there is provided a spark plug for an internal combustion engine characterized in that, in configuration 6 mentioned above, the coating layer has a Vickers hardness of 100 Hv or less and has a ten-point height of irregularities of 12.5 μm or less as measured on a surface thereof which comes into contact with the head.

According to configuration 7 mentioned above, a portion of the coating layer which comes into contact with the head has a Vickers hardness of 100 Hv or less, and a surface of the coating layer which comes into contact with the head has a ten-point height of irregularities of 12.5 μm or less. Therefore, the spark plug (coating layer) can be more reliably brought into close contact with the head, whereby gastightness of a combustion engine can be further improved.

Configuration 8. In accordance with an eighth aspect of the present invention, there is provided a spark plug for an internal combustion engine characterized in that, in configurations 6 or 7 mentioned above, the coating layer has a thickness of 5 μm to 300 μm inclusive.

According to configuration 8 mentioned above, since the coating layer having a thickness of 5 μm or greater covers the surface of the seat portion, the seat portion (coating layer) can be more reliably brought into close contact with the head. As a result, gastightness can be further improved.

When the thickness of the coating layer exceeds 300 μm, gastightness may be impaired due to impairment in contact between the seat portion and the coating layer. Therefore, preferably, the thickness of the coating layer is 300 μm or less.

DETAILED DESCRIPTION OF PREFERRED EMBODIMENTS

First Embodiment

Figure 1:
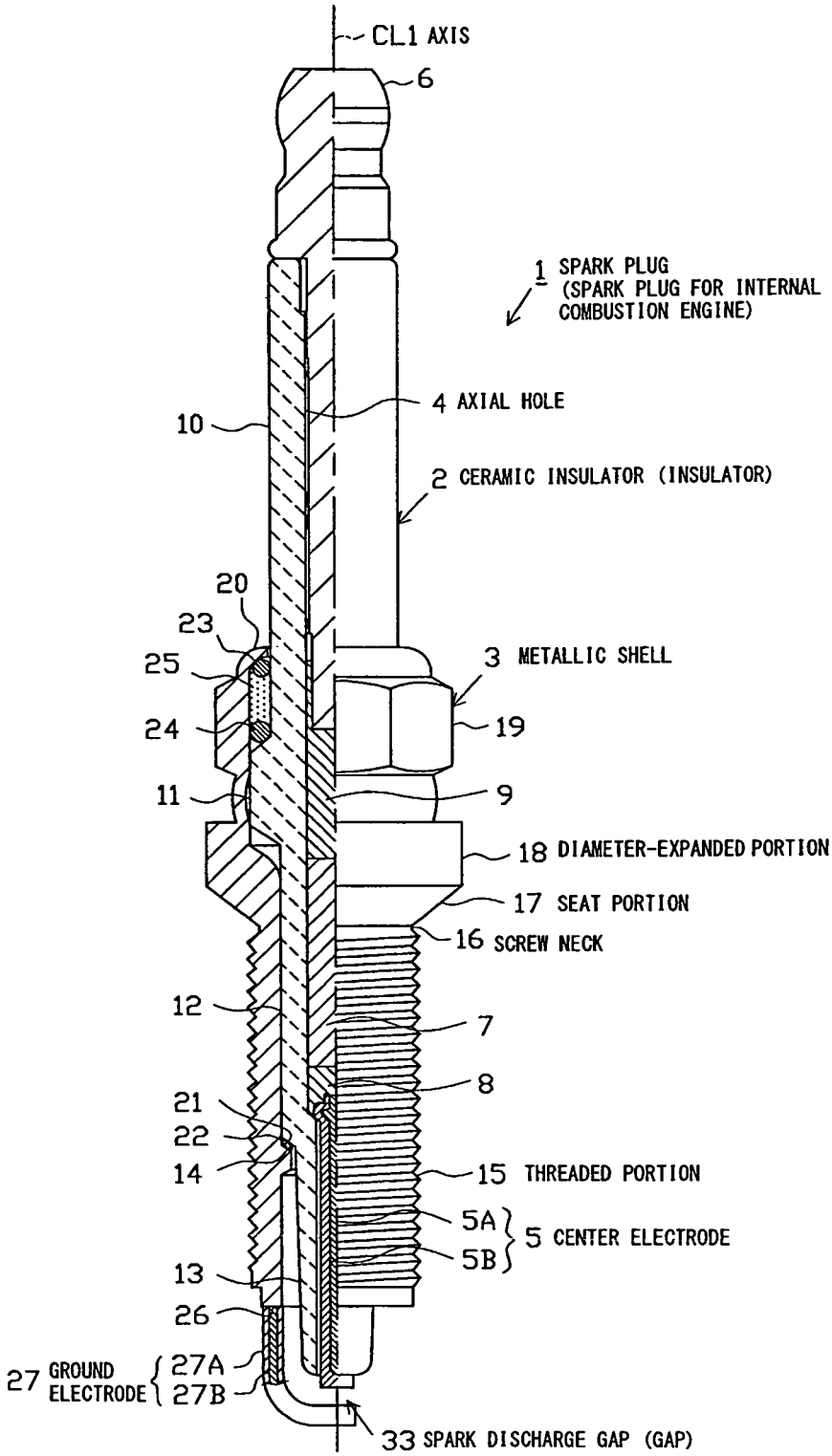
FIG. 1 is a partially sectioned, front view showing the configuration of a spark plug according to a first embodiment of the present invention.

Embodiments of the present invention will next be described with reference to the drawings. FIG. 1 is a partially sectioned, front view showing a spark plug for an internal combustion engine (hereinafter, referred to as "spark plug") 1. In FIG. 1, the direction of an axis CL1 of the spark plug 1 is referred to as the vertical direction. In the following description, the lower side of the spark plug 1 in FIG. 1 is referred to as the front side of the spark plug 1, and the upper side as the rear side.

The spark plug 1 includes a ceramic insulator 2, which is the tubular insulator in the present invention, and a tubular metallic shell 3, which holds the ceramic insulator 2 therein.

The ceramic insulator 2 is formed from alumina or the like by firing, as well known in the art. The ceramic insulator 2, as viewed externally, includes a rear trunk portion 10 formed on the rear side. A large-diameter portion 11 is located frontward of the rear trunk portion 10 and projects radially outward. An intermediate trunk portion 12 is located frontward of the large-diameter portion 11 and is smaller in diameter than the large-diameter portion 11. A leg portion 13 is located frontward of the intermediate trunk portion 12 and is smaller in diameter than the intermediate trunk portion 12. The large-diameter portion 11, the intermediate trunk portion 12, and most of the leg portion 13 of the ceramic insulator 2 are accommodated in the metallic shell 3. A tapered, stepped portion 14 is formed at a connection portion between the leg portion 13 and the intermediate trunk portion 12. The ceramic insulator 2 is seated on the metallic shell 3 at the stepped portion 14.

Further, the ceramic insulator 2 has an axial hole 4 extending therethrough along the axis CL1. A center electrode 5 is fixedly inserted into a front end portion of the axial hole 4. The center electrode 5 includes an inner layer 5A made of copper or a copper alloy, and an outer layer 5B made of a Ni alloy which contains nickel (Ni) as a main component. The center electrode 5 assumes a rod-like (circular columnar) shape as a whole, has a flat front end surface and projects from the front end of the ceramic insulator 2.

Also, a terminal electrode 6 is fixedly inserted into a rear end portion of the axial hole 4 and projects from the rear end of the ceramic insulator 2.

Further, a circular columnar resistor 7 is disposed within the axial hole 4 between the center electrode 5 and the terminal electrode 6. Opposite end portions of the resistor 7 are electrically connected to the center electrode 5 and the terminal electrode 6 via electrically conductive glass seal layers 8 and 9, respectively.

The metallic shell 3 is formed into a tubular shape from a low-carbon steel or a like metal. The metallic shell 3 has, on its outer circumferential surface, a threaded portion 15, a screw neck 16, a seat portion 17, and a diameter-expanded portion 18, which are arranged sequentially from the front side toward the rear side along the axis CL1.

The threaded portion 15 is dimensioned to threadingly engage with a mounting hole 43 of a head 42 of an internal combustion engine 41, which will be described later. In the present embodiment, the threaded portion 15 has a thread diameter of M14. The screw neck 16 is formed continuously from the rear end of the threaded portion 15 and has a circular columnar shape having a diameter smaller than the thread diameter of the threaded portion 15. Further, the seat portion 17 is expanded in diameter rearward with respect to the direction of the axis CL1 and connectingly extends between the rear end of the screw neck 16 and the front end of the diameter-expanded portion 18. The seat portion 17 is formed such that, as viewed on a section which contains the axis CL1, the angle between the axis CL1 and the outline of the seat portion 17 is relatively large (e.g., 60° to 90° inclusive). The diameter-expanded portion 18 extends rearward from the rear end of the seat portion 17 and assumes a circular columnar shape. A tool engagement portion 19 having a hexagonal cross section is provided rearward of the diameter-expanded portion 18. The tool engagement portion is dimensioned to allow a tool, such as a wrench, to be engaged therewith when the spark plug 1 is to be mounted to an engine head. Additionally, a crimp portion 20 is provided at a rear end portion of the metallic shell 3 for retaining the ceramic insulator 2.

Further, the metallic shell 3 has a tapered, stepped portion 21 provided on its inner circumferential surface, which stepped portion 21 is adapted to allow the ceramic insulator 2 to be seated thereon. The ceramic insulator 2 is inserted frontward into the metallic shell 3 from the rear end of the metallic shell 3. In a state in which the stepped portion 14 of the ceramic insulator 2 butts against the stepped portion 21 of the metallic shell 3, a rear-end opening portion of the metallic shell 3 is crimped radially inward; i.e., the crimp portion 20 is formed, whereby the ceramic insulator 2 is fixed in place. An annular sheet packing 22 is disposed between the stepped portions 14 and 21 of the ceramic insulator 2 and the metallic shell 3, respectively. This retains gastightness of a combustion chamber and prevents leakage of air-fuel mixture to the exterior of the spark plug 1 through a clearance between the inner circumferential surface of the metallic shell 3 and the leg portion 13 of the ceramic insulator 2, which leg portion 13 is exposed to the combustion chamber.

Further, in order to ensure gastightness which is established by crimping, annular ring members 23 and 24 are disposed between the metallic shell 3 and the insulator 2 in a region near the rear end of the metallic shell 3. A space between the ring members 23 and 24 is filled with a powder of talc 25. That is, the metallic shell 3 holds the ceramic insulator 2 via the sheet packing 22, the ring members 23 and 24, and the talc 25.

A ground electrode 27 is joined to a front end portion 26 of the metallic shell 3 and is bent at an intermediate portion thereof such that the side surface of a distal (free) end portion thereof faces a front end portion of the center electrode 5. The ground electrode 27 has a 2-layer structure consisting of an outer layer 27A made of an Ni alloy (e.g., INCONEL 600 or INCONEL 601 (registered trademark)) and an inner layer 27B made of a copper alloy or copper, which is superior in heat conduction to the Ni alloy. A spark discharge gap 33, which is the gap in the present invention, is formed between the ground electrode 27 and the front end portion of the center electrode 5. Spark discharges are generated across the spark discharge gap 33 substantially along the direction of the axis CL1.

Figure 2:
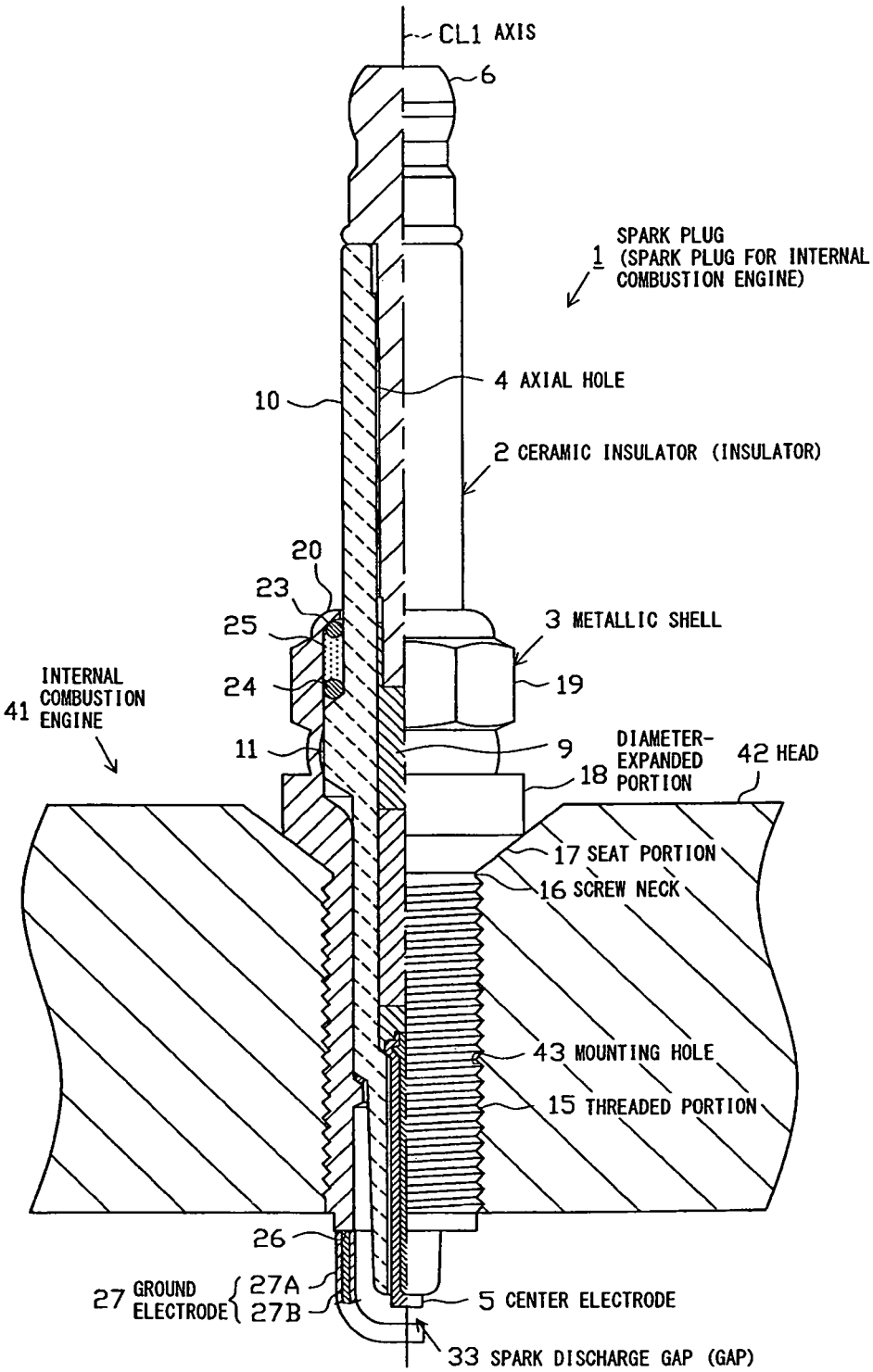
FIG. 2 is a partially sectioned, front view showing the spark plug in FIG. 1 mounted to an internal combustion engine.

Further, in the present embodiment, as shown in FIG. 2, when the threaded portion 15 is mounted into the mounting hole 43 of the head 42 of the internal combustion engine 41, the seat portion 17 comes in close contact with the head 42, thereby maintaining gastightness of a combustion chamber. A Vickers hardness of 250 Hv or less (e.g., 180 Hv) is imparted to the seat portion 17 through employment of a manufacturing method to be described later. Meanwhile, the head 42 is formed of a relatively soft (e.g., 100 Hv) alloy which contains aluminum as a main component. Therefore, the seat portion 17 is higher in hardness than the head 42.

Also, the seat portion 17 is smoothed such that its surface has a ten-point height of irregularities of 12.5 μm or less (e.g., 10 μm). The ten-point height of irregularities is specified in JIS B0601.

The thread diameter of the threaded portion 15 (described above as being M14) may be further reduced. However, in the event that the threaded portion 15 has a thread diameter of M12 or less, a Vickers hardness of 200 Hv or less is imparted to the seat portion 17.

Next, a method of manufacturing the spark plug 1 configured as mentioned above is described. First, the metallic shell 3 is formed beforehand. Specifically, a circular columnar metal material (e.g., an iron-based material, such as S17C or S25C, or a stainless steel material) is subjected to machining for forming a through hole and for adjusting the outline, thereby yielding a metallic-shell intermediate. In this manner, in the present embodiment, the metallic shell intermediate is formed only through subjection to machining. As a result, an increase in hardness of a region corresponding to the seat portion 17 is restrained.

Subsequently, the ground electrode 27, having the form of a rod and formed of a Ni alloy, is resistance-welded to the front end surface of the metallic-shell intermediate. The resistance welding is accompanied by formation of so-called "slags." After the "slags" are removed, the threaded portion 15 is formed in a predetermined region of the metallic-shell intermediate by rolling. Further, a region of the metallic-shell intermediate which corresponds to the seat portion 17 is subjected to polishing or the like so as to impart a ten-point height of irregularities (surface finish) of 12.5 μm or less to the surface of the seat portion 17. Thus, the metallic shell 3 to which the ground electrode 27 is joined is obtained. The metallic shell 3 to which the ground electrode 27 is joined may be subjected to galvanization or nickel plating. In order to enhance corrosion resistance, the plated surface may be further subjected to chromate treatment.

Separately from preparation of the metallic shell 3, the insulator 2 is formed. For example, a forming material of granular substance is prepared by use of a material powder which contains alumina in a predominant amount, a binder, etc. By use of the prepared forming material of granular substance, a tubular green compact is formed by rubber press forming. The thus-formed green compact is subjected to grinding for shaping the outline. The shaped green compact is placed in a kiln, followed by firing for forming the insulator 2.

Separately from preparation of the metallic shell 3 and the insulator 2, the center electrode 5 is formed. Specifically, a Ni alloy prepared such that a copper alloy is disposed in a central portion thereof for enhancing heat radiation is subjected to forging, thereby forming the center electrode 5.

Then, the ceramic insulator 2 and the center electrode 5, which are formed as mentioned above, the resistor 7, and the terminal electrode 6 are fixed in a sealed condition by means of the glass seal layers 8 and 9. In order to form the glass seal layers 8 and 9, generally, a mixture of borosilicate glass and a metal powder is prepared, and the prepared mixture is charged into the axial hole 4 of the ceramic insulator 2 such that the resistor 7 is sandwiched therebetween. Subsequently, the resultant assembly is heated in a kiln in a condition in which the charged mixture is pressed from the rear by the terminal electrode 6, thereby being fired and fixed. At this time, a glaze layer may be simultaneously fired on the surface of the rear trunk portion 10 of the ceramic insulator 2. Alternatively, the glaze layer may be formed beforehand.

Subsequently, the thus-formed ceramic insulator 2 having the center electrode 5 and the terminal electrode 6, and the metallic shell 3 having the ground electrode 27 are assembled together. More specifically, a relatively thin-walled rear-end opening portion of the metallic shell 3 is crimped radially inward; i.e., the above-mentioned crimp portion 20 is formed, thereby fixing the ceramic insulator 2 and the metallic shell 3 together.

Finally, the distal end portion of the ground electrode 27 is bent toward the center electrode 5, thereby adjusting the spark discharge gap 33 between the center electrode 5 and the ground electrode 27. Thus, the spark plug 1 described above is yielded.

As described in detail above, according to the present embodiment, the seat portion 17 is higher in hardness than the head 42. Therefore, even when the spark plug 1 is mounted to and demounted from the head 42 a plurality of times, plastic deformation of the seat portion 17 associated with contact of the seat portion 17 with the head 42 can be effectively prevented. Also, since the seat portion 17 has a Vickers hardness of 250 Hv or less (200 Hv or less when the threaded portion 15 has a thread diameter of M12 or less), even when mounting and demounting the spark plug 1 is performed a plurality of times, deformation of the head 42 is unlikely to occur.

Thus, the present embodiment can reliably prevent occurrence of damage, strain, or the like on the seat portion 17 and the head 42, which are important components with regard to ensuring of gastightness of a combustion chamber. As a result, a more reliable seal can be provided between the seat portion 17 and the head 42, and, in turn, a combustion chamber can enjoy excellent gastightness.

When a Vickers hardness of 200 Hv or less is imparted to the seat portion 17, occurrence of damage, strain, or the like on the seat portion 17 and the head 42 can be more reliably prevented, and the seat portion 17 can be more reliably brought into close contact with the head 42. Thus, gastightness of a combustion chamber can be further improved.

Further, since the surface of the seat portion 17 has a ten-point height of irregularities (surface finish) of 12.5 μm or less, the seat portion 17 can be more reliably brought into close contact with the head 42, whereby gastightness of a combustion chamber can be further improved.

Also, the seat portion 17 is formed such that a relatively large angle is formed between its outline and the axis CL1. Thus, when the spark plug 1 is mounted to the internal combustion engine 41, biting of the seat portion 17 into the head 42 can be more reliably prevented, whereby gastightness can be further improved.

Figure 3:
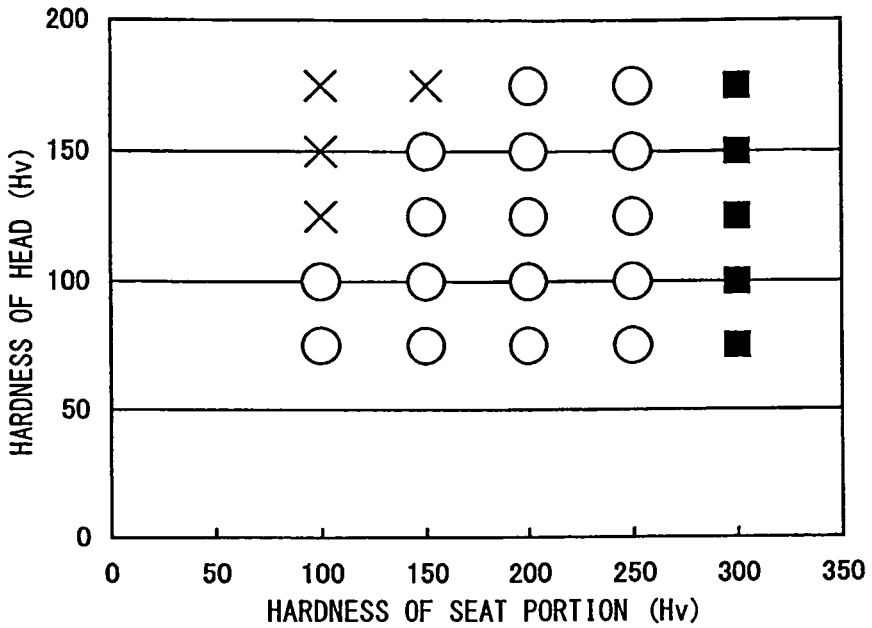
FIG. 3 is a graph showing the results of a gastightness evaluation test conducted on samples having a thread diameter of M14.
Figure 4:
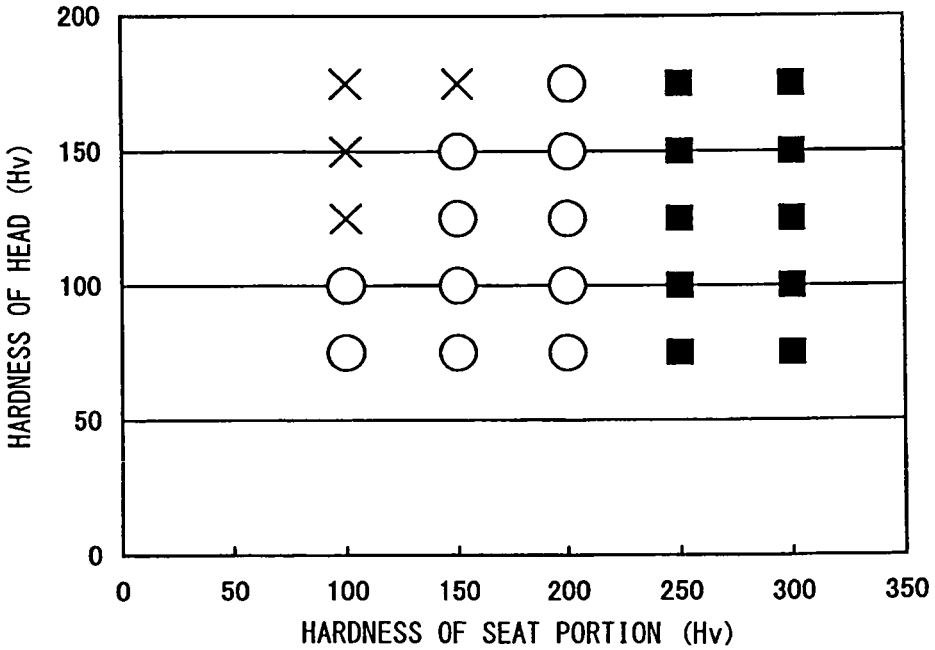
FIG. 4 is a graph showing the results of a gastightness evaluation test conducted on samples having a thread diameter of M12.
Figure 5:
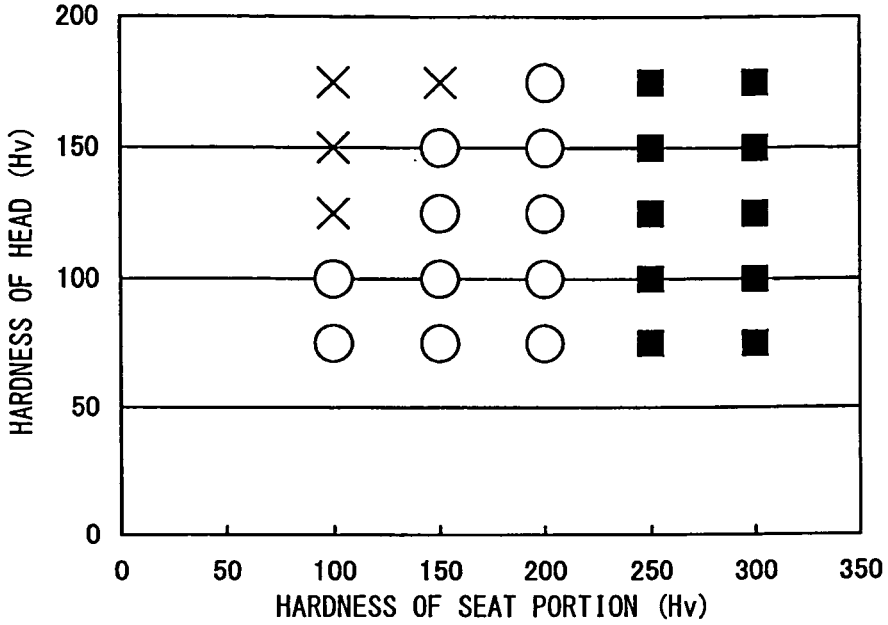
FIG. 5 is a graph showing the results of a gastightness evaluation test conducted on samples having a thread diameter of M10.

Next, in order to verify actions and effects yielded by the above embodiment, a gastightness evaluation test was conducted. The gastightness evaluation test is briefly described below. There were fabricated spark plug samples which differed in thread diameter of the threaded portion and hardness of the seat portion, as well as aluminum test beds which simulated an engine head and differed in hardness of a portion to come into contact with the seat portion (hardness of the head). A test cycle consists of the following: the samples are mounted to the test beds with a tightening torque of 15 N·m; in a condition in which the samples are heated at 150° C. and an air pressure of 1.5 MPa is applied, air leakage per minute (ml/min) along the interfaces between the samples and the test beds is measured; and finally, the samples are demounted from the test beds. The samples were subjected to five test cycles (i.e., the same sample was mounted to and demounted from the same test bed five times). Evaluation was made on the following criteria: when the air leakage is less than 2 ml/min in all of the five test cycles, evaluation is considered "good," which is represented by a "circle," indicating that good gastightness is implemented. When the air leakage is 2 ml/min or greater in at least one of the five test cycles, evaluation is considered "failure," which is represented by a "cross," indicating that gastightness is insufficient. When deformation of the test bed is observed after completion of the test cycle, evaluation is considered "potential failure," which is represented by a "black square," indicating that gastightness of a combustion chamber may become insufficient. FIGS. 3 to 5 show the results of the gastightness evaluation test. Notably, FIG. 3 shows the test results in the case where the samples have a thread diameter of M14. FIG. 4 shows the test results in the case where the samples have a thread diameter of M12. FIG. 5 shows the test results in the case where the samples have a thread diameter of M10.

As shown in FIGS. 3 to 5, in the case where the seat portion is lower in hardness than the head, gastightness of a combustion chamber becomes insufficient. Conceivably, this (the "insufficient gastightness") is for the following reason. Since the seat portion is lower in hardness than the head, the seat portion is apt to be susceptible to plastic deformation. Consequently, when the spark plug samples were mounted and demounted repeatedly, the seat portions suffered marked deformation.

By contrast, in the case of the samples in which the seat portion has hardness equal to or higher than that of the head, excellent gastightness can be seen. Conceivably, this improved gastightness is for the following reason. By virtue of the seat portion having hardness equal to or higher than that of the head, the likelihood of plastic deformation of the seat portion could be reduced to the greatest possible extent. However, in the case of the samples whose threaded portion had a thread diameter of M14 and in which the seat portion had a hardness in excess of 250 Hv, and the samples whose threaded portion had a thread diameter of M12 or less and in which the seat portion had a hardness in excess of 200 Hv, deformation of the test beds was observed after completion of the test cycles. Therefore, in order to ensure excellent gastightness of a combustion chamber, in addition to the seat portion being higher in hardness than the head, it is important that a hardness of 250 Hv or less be imparted to the seat portion in the case of a thread diameter of the threaded portion of M14 and a hardness of 200 Hv or less be imparted to the seat portion in the case of a thread diameter of the threaded portion of M12 or less.

Figure 6:
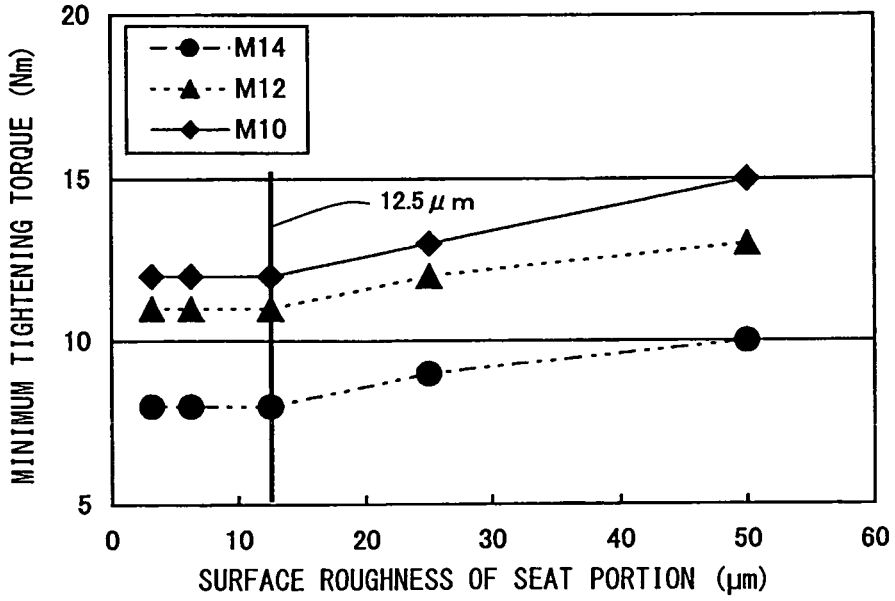
FIG. 6 is a graph showing the relation between the surface roughness of a seat portion and the minimum tightening torque.

Next, there were fabricated spark plug samples which differed in thread diameter of the threaded portion and ten-point height of irregularities of the surface of the seat portion (surface roughness of seat portion). The samples were mounted to an aluminum test bed which simulated an engine head, while tightening torque was varied. In a condition in which the samples were heated at 150° C. and an air pressure of 1.5 MPa was applied, there were identified the samples and their tightening torques (minimum tightening torques) associated with an air leakage per minute along the interfaces between the samples and the test bed of 2 ml/min or greater. The smaller the minimum tightening torque of a sample, the more easily the sample can implement sufficient gastightness; i.e., the sample is more advantageous for implementation of gastightness. FIG. 6 is a graph showing the relation between the surface roughness (surface finish) of the seat portion and the minimum tightening torque. In FIG. 6, the test results of the samples having a thread diameter of M14 are plotted in heavy dots. The test results of the samples having a thread diameter of M12 are plotted in black triangles. The test results of the samples having a thread diameter of M10 are plotted in black diamonds. A hardness of 150 Hv was imparted to the seat portions of the samples, and a hardness of 100 Hv was imparted to portions of the test bed which came into contact with the seat portions.

As shown in FIG. 6, the samples whose seat portions had a surface roughness of 12.5 μm or less exhibited relatively small, constant values of minimum tightening torque. However, the samples whose seat portions had a surface roughness in excess of 12.5 μm exhibited an increase in minimum tightening torque. That is, the samples whose seat portions have a surface roughness (surface finish) in excess of 12.5 μm encounter difficulty in bringing the seat portion and the head in close contact with each other; i.e., difficulty in ensuring a seal between the seat portion and the head. Therefore, in view of implementation of excellent gastightness, imparting a surface roughness of 12.5 μm or less to the seat portion is significant.

Second Embodiment

Next, a second embodiment of the present invention will be described with reference to the drawings, particularly centering on points of difference from the first embodiment.

Figure 7:
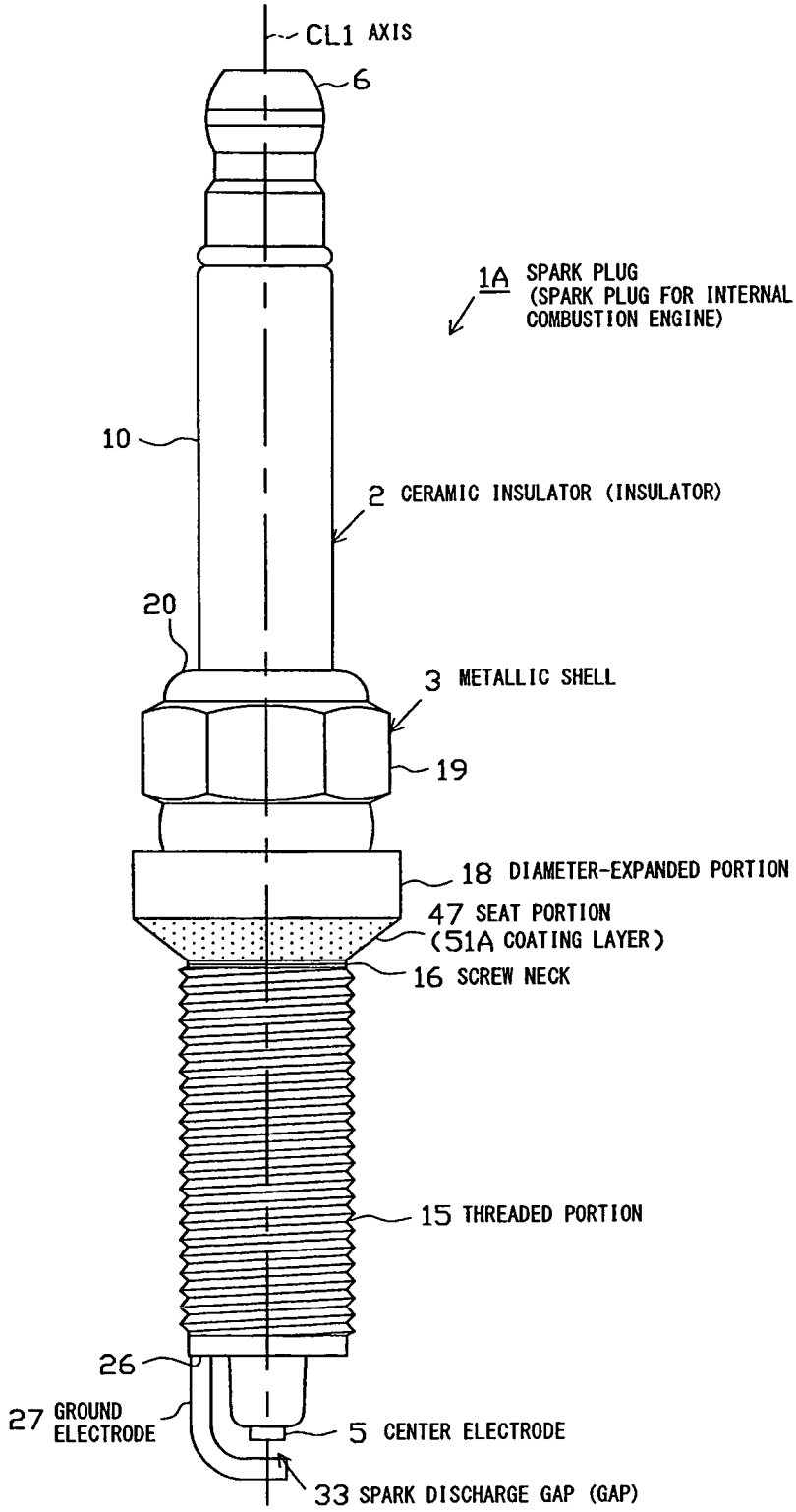
FIG. 7 is a front view showing the configuration of a spark plug according to a second embodiment of the present invention.

As compared with the first embodiment described above, as shown in FIG. 7, a spark plug 1A of the present second embodiment is characterized particularly in that a coating layer 51A covers the surface of the seat portion 47 of the metallic shell 3. The coating layer 51A is formed of a material (e.g., fluororesin) having a softening point of 200° C. or higher and is lower in hardness than the head 42. Specifically, the coating layer 51A has a Vickers hardness of 100 Hv or less.

Figure 8:
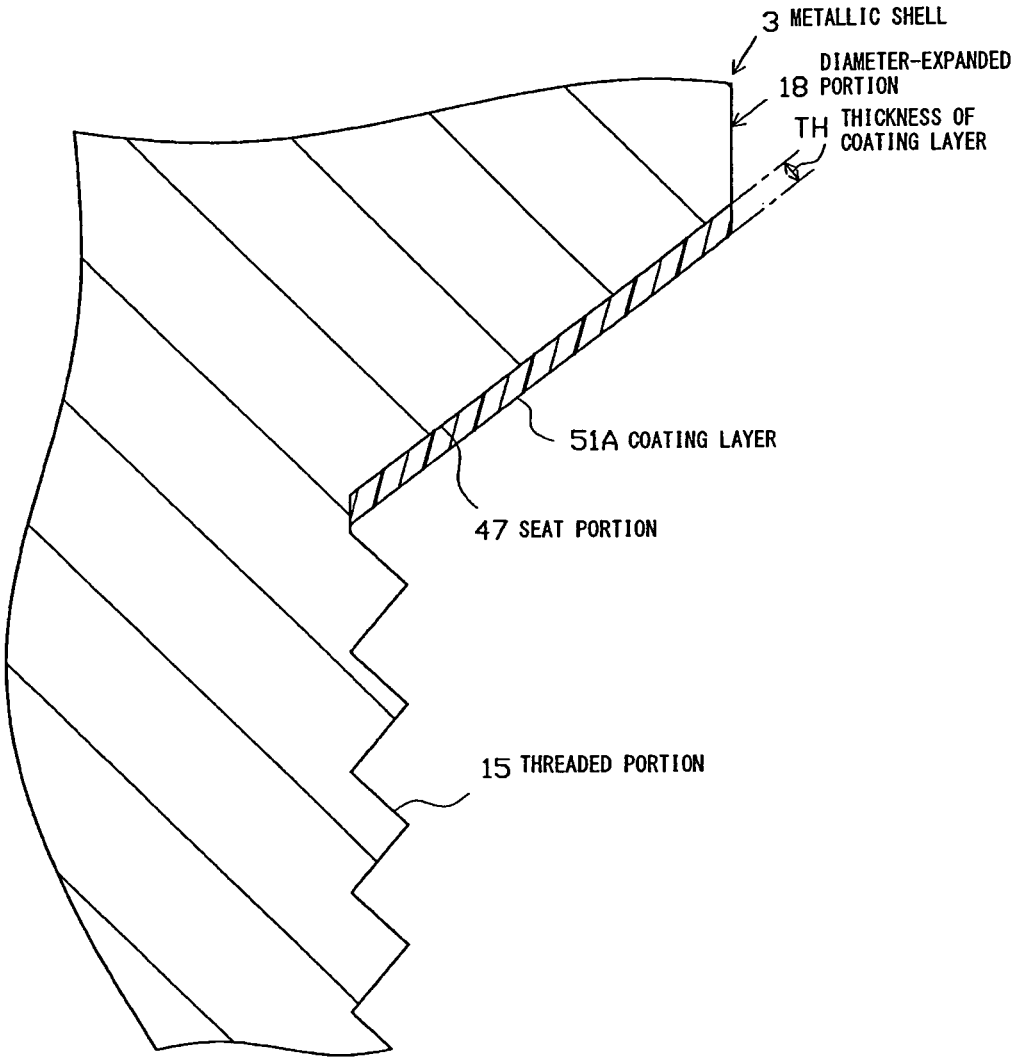
FIG. 8 is an enlarged partial sectional view showing the constitution of a coating layer in the second embodiment.

As shown in FIG. 8, the coating layer 51A has a sufficiently large thickness TH of 5 μm to 300 μm inclusive. Additionally, the coating layer 51A has a ten-point height of irregularities of 12.5 μm or less as measured on a surface thereof which comes into contact with the head 42.

The present second embodiment differs from the first embodiment described above in hardness of the seat portion 47. Specifically, the seat portion 47 has a Vickers hardness in excess of 200 Hv (e.g., 220 Hv).

According to the second embodiment, the coating layer 51A is lower in hardness than the head 42. Thus, the coating layer 51A can be more reliably brought into close contact with the head 42, and occurrence of damage on the head 42 can be reliably restrained. Also, since a material used to form the coating layer 51A has a softening point of 200° C. or higher, thermal deformation of the coating layer 51A can be restrained in a high-temperature environment in which the spark plug is used. That is, the second embodiment can ensure sufficient gastightness of a combustion chamber by virtue of the actions and effects mentioned above.

Further, since fluororesin used to form the coating layer 51A is elastically deformable, even when the spark plug is mounted and demounted to and from the head 42 a plurality of times, deformation of the coating layer 51A can be more reliably prevented.

Additionally, since the thickness of the coating layer 51A is specified to be 5 μm to 300 μm inclusive, the spark plug (coating layer 51A) can be more reliably brought into close contact with the head 42, and gastightness can be further improved.

Also, since the coating layer 51A has a Vickers hardness of 100 Hv or less, and a surface of the coating layer 51A which comes into contact with the head has a ten-point height of irregularities of 12.5 μm or less, the spark plug (coating layer 51A) can be more reliably brought into close contact with the head.

Figure 9:
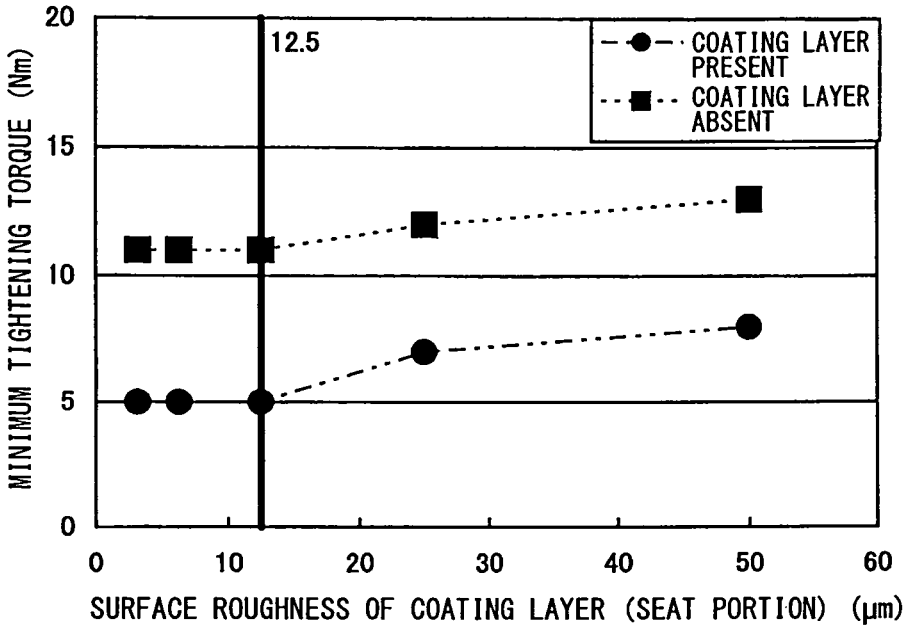
FIG. 9 is a graph showing the relation between the surface roughness of a coating layer (seat portion) and the minimum tightening torque.

Next, in order to verify actions and effects yielded by the second embodiment described above, spark plug samples which differed in surface roughness of the coating layer formed of fluororesin were fabricated. Spark plug samples which differed in surface roughness of the seat portion without provision of the coating layer (no coating layer) were also fabricated. The samples were measured for minimum tightening torque mentioned above. FIG. 9 is a graph showing the relation between the minimum tightening torque and the surface roughness of the coating layer (seat portion). In FIG. 9, the test results of the samples having the coating layer are plotted in heavy dots, and the test results of the samples having no coating layer are plotted in black squares. A hardness of 150 Hv was imparted to the seat portions of the samples, and a hardness of 100 Hv was imparted to portions of the test bed which came into contact with the seat portions. Additionally, in the samples having the coating layer, the coating layer had a thickness of 50 μm.

As shown in FIG. 9, as compared with the samples having no coating layer, the samples having the coating layer exhibit smaller minimum tightening torques, regardless of the magnitude of surface roughness. Therefore, in view of easy implementation of excellent gastightness, provision of the coating layer which covers the seat portion can be said to be significant.

It has been confirmed that, when the surface roughness of the coating layer exceeds 12.5 μm, the minimum tightening torque slightly increases. Therefore, in order to reliably implement excellent gastightness, preferably, the coating layer surface has a ten-point height of irregularities of 12.5 μm or less.

Figure 10:
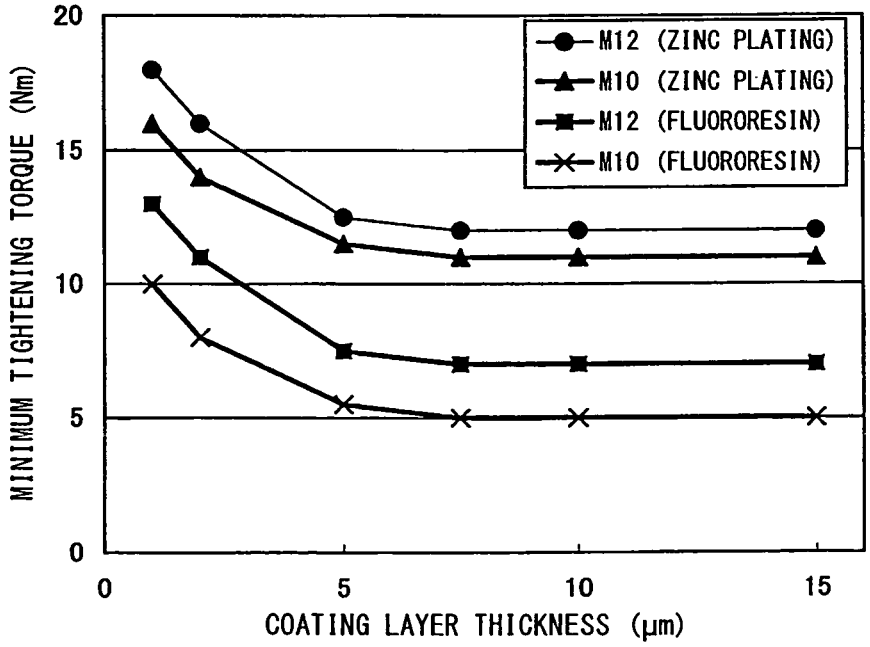
FIG. 10 is a graph showing the relation between the minimum tightening torque and the thickness of the coating layer and the relation between the minimum tightening torque and materials used to form the coating layer.

Next, there were fabricated spark plug samples whose threaded portions had a thread diameter of M10 or M12 and which differed in the thickness of the coating layer formed of fluororesin or zinc plating in such a manner as to cover the surface of the seat portion. The samples were measured for minimum tightening torque mentioned above. FIG. 10 is a graph showing the relation between the minimum tightening torque and the thickness of the coating layer.

The coating layer formed of fluororesin had a Vickers hardness of 60 Hv, and the coating layer formed of zinc plating had a Vickers hardness of 120 Hv. Additionally, in FIG. 10, the test results of the samples having the coating layer formed of zinc plating and a thread diameter of M12 are plotted in heavy dots. The test results of the samples having the coating layer formed of zinc plating and a thread diameter of M10 are plotted in black triangles. The test results of the samples having the coating layer formed of fluororesin and a thread diameter of M12 are plotted in black squares. The test results of the samples having the coating layer formed of fluororesin and a thread diameter of M10 are plotted in crosses.

As shown in FIG. 10, the samples whose coating layer had a thickness of 5 μm or greater exhibited relatively small, constant values of minimum tightening torque. However, the samples whose coating layer had a thickness of less than μm exhibited an increase in minimum tightening torque. Conceivably, this is for the following reason: as a result of the coating layer having a sufficiently large thickness of 5 μm or more, contact of the samples with the test bed could be further enhanced.

As compared with the samples whose coating layers are formed of zinc plating, the samples whose coating layers are formed of fluororesin can implement further enhanced gastightness. Conceivably, this is for the following reason: since the coating layers formed of fluororesin had relatively low hardness, contact of the samples with the test bed was further enhanced.

In view of further improvement of gastightness, preferably, the coating layer is formed on the surface of the seat portion, and the coating layer has a thickness of 5 μm or greater. More preferably, the hardness of the coating layer is relatively lower (100 Hv or less). However, when the coating layer is excessively thick, the above-mentioned actions and effects for improving gastightness may fail to be sufficiently yielded. Therefore, preferably, the coating layer has a thickness of 300 μm or less.

Third Embodiment

Next, a third embodiment of the present invention will be described, particularly centering on points of difference from the first embodiment.

Figure 11:
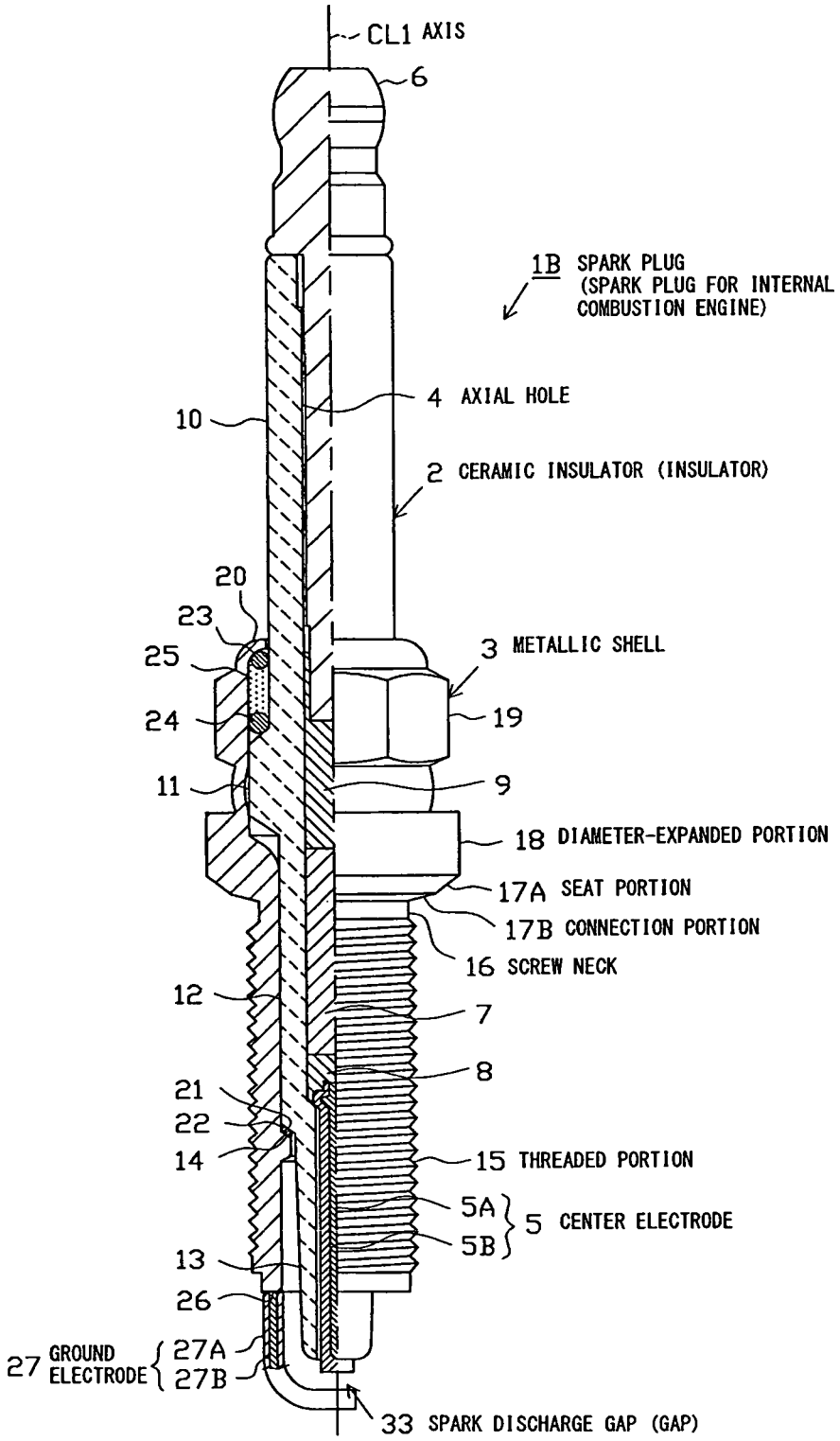
FIG. 11 is a partially sectioned, front view showing the configuration of a spark plug according to a third embodiment of the present invention.

As shown in FIG. 11, a spark plug 1B of the third embodiment has a different seat portion 17A. Specifically, in the first embodiment described above, the front end of the seat portion 17 is connected to the rear end of the screw neck 16, whereas, in the present third embodiment, a connection portion 17B is formed between the front end of the seat portion 17A and the rear end of the screw neck 16.

Figure 12:
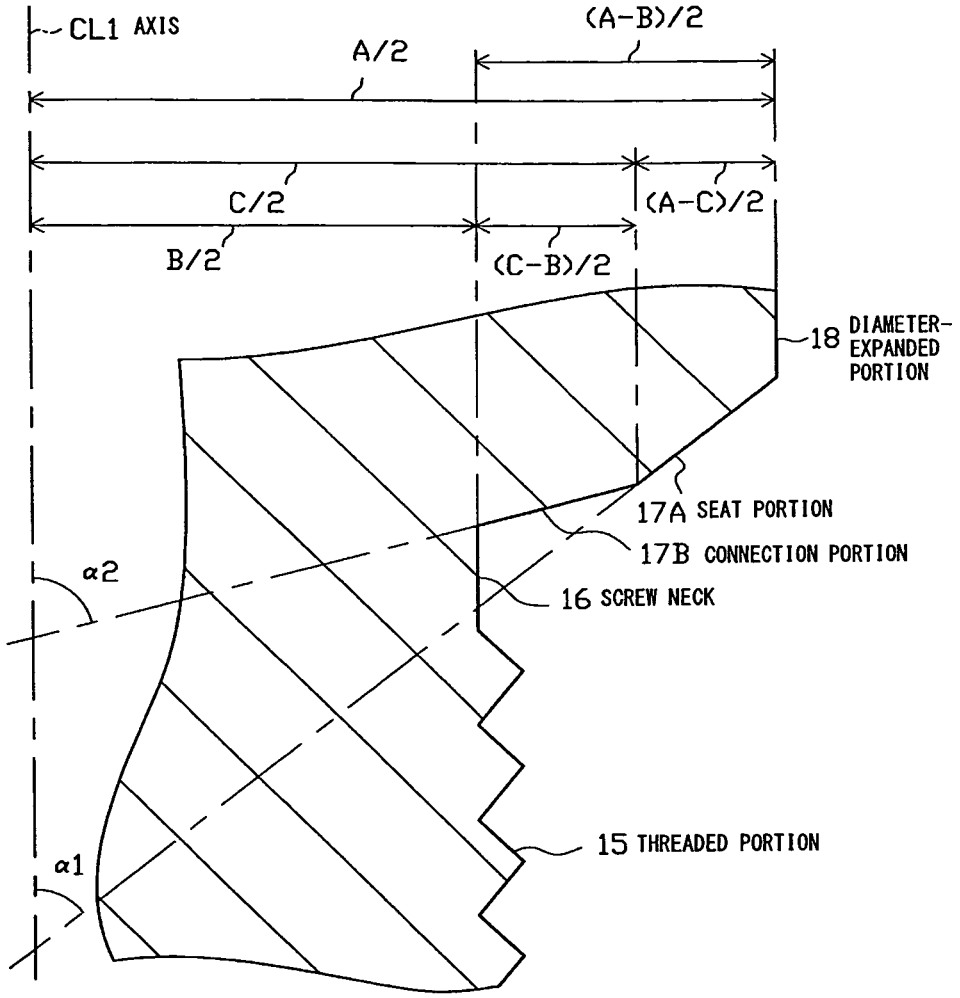
FIG. 12 is an enlarged partial sectional view for explaining the constitution of the seat portion and a connection portion, etc.

Also, while the thread diameter of the threaded portion 15 is reduced to M12 or less, the sizes of the diameter-expanded portion 18 and the tool engagement portion 19 are substantially similar to conventionally employed ones. Thus, as shown in FIG. 12, when A (mm) represents the outside diameter of the front end of the diameter-expanded portion 18, and B (mm) represents the minimum outside diameter of the screw neck 16, (A−B)/2 assumes a value of 0.8 mm or greater, i.e., A−B assumes a relatively large value of 1.6 mm or greater (e.g., 2.0 mm or greater). Notably, if the diameter-expanded portion 18 has an excessively large diameter, layout flexibility may be impaired with respect to an engine to which the spark plug 1B is to be mounted. Therefore, the outside diameter A of the front end of the diameter-expanded portion 18 is specified to be 19.0 mm or less.

Further, the present third embodiment specifies the position of the boundary between the seat portion 17A and the connection portion 17B as follows. When C (mm) represents the outside diameter of the boundary between the seat portion 17A and the connection portion 17B, the position of the boundary between the seat portion 17A and the connection portion 17B is determined such that (C−B)/2 is 0.3 mm or greater, and (A−C)/2 is 0.7 mm or greater.

Figure 13:
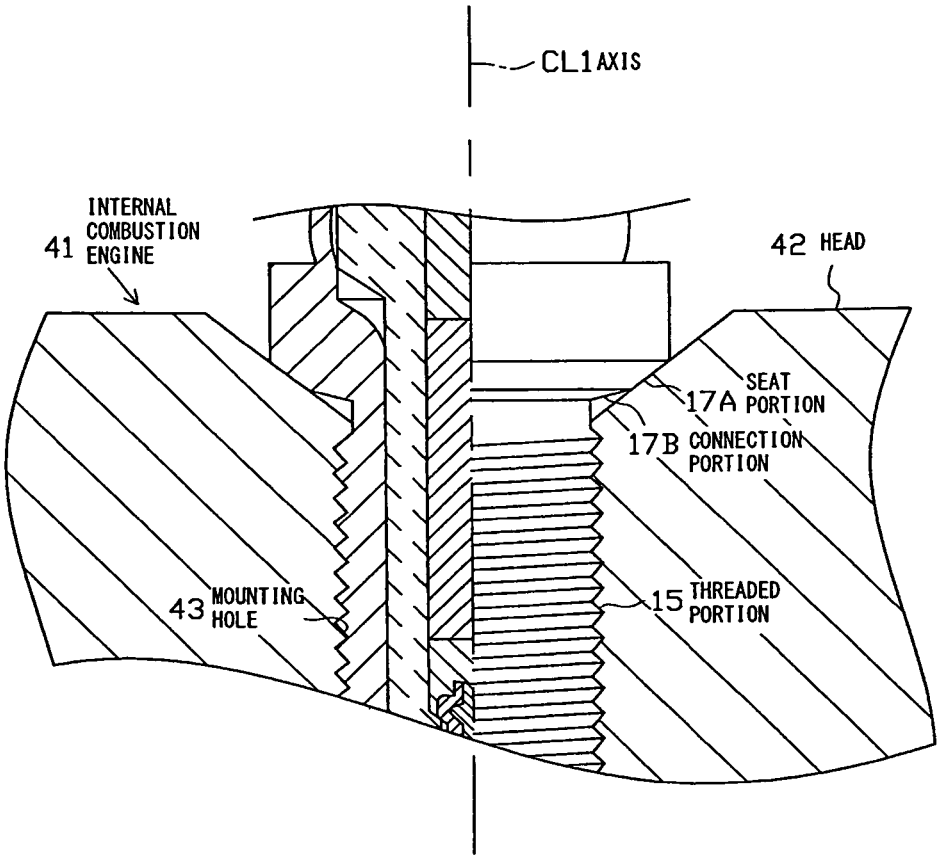
FIG. 13 is an enlarged, partially sectioned front view showing a state in which the spark plug is mounted to the internal combustion engine.

Additionally, the seat portion 17A and the connection portion 17B tapers frontward with respect to the direction of the axis CL1. As viewed on a section which contains the axis CL1, an angle α2 between the axis CL1 and the outline (extension line of the outline) of the connection portion 17B is greater than an angle α1 between the axis CL1 and the outline (extension line of the outline) of the seat portion 17A. Therefore, as shown in FIG. 13, when the spark plug 1B is mounted into the mounting hole 43 of the head 42 of the internal combustion engine 41, only the seat portion 17A comes into close contact with the head 42, without the connection portion 17B coming into contact with the head 42.

Also, according to the present third embodiment, the angle α1 between the axis CL1 and the outline of the seat portion 17A is 60 degrees to 70 degrees inclusive.

Thus, according to the present third embodiment, as viewed on the section which contains the axis CL1, the angle α2 between the axis CL1 and the connection portion 17B is greater than the angle α1 between the axis CL1 and the seat portion 17A. That is, when the spark plug 1B is mounted to the internal combustion engine 41, only the seat portion 17A comes into contact with the head 42. Thus, as compared with the case where the entire surface of the seat portion 17A and the connection portion 17B is brought into close contact with the head 42, the area of a region in close contact with the head 42 can be reduced, whereby the spark plug 1B can be reliably brought into close contact with the head 42 without need to increase the tightening force. As a result, sufficient gastightness of a combustion chamber can be ensured.

Also, through employment of (C−B)/2<0.3 mm, an excessive increase in the area of the seat portion 17A can be prevented; and, through employment of (A−C)/2<0.7 mm, a sufficient area can be maintained for the seat portion 17A. Thus, impairment in gastightness can be more reliably prevented.

Further, since the angle α1 between the axis CL1 and the seat portion 17A is 60° or greater, biting of the seat portion 17A into the head 42 can be prevented. Thus, even when mounting and demounting the spark plug 1B is performed a plurality of times, excellent gastightness can be ensured. Meanwhile, since the angle α1 is specified to be 70° or less, contact of the seat portion 17A with the head 42 can be sufficiently improved, whereby excellent gastightness can be implemented.

Fourth Embodiment

Next, a fourth embodiment of the present invention will be described with reference to the drawing, particularly centering on points of difference from the third embodiment.

Figure 14:
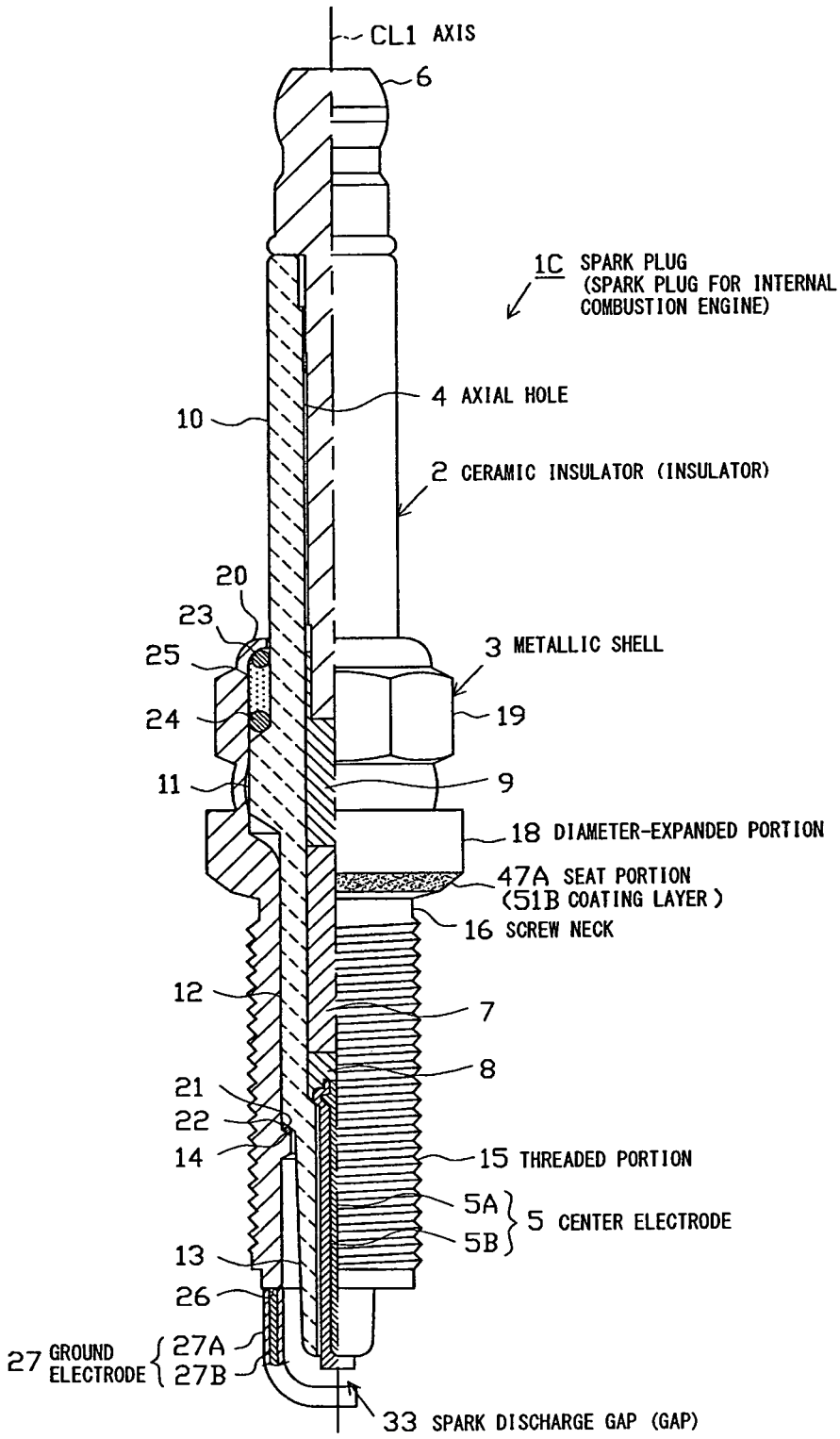
FIG. 14 is a partially sectioned, front view showing the configuration of a spark plug according to a fourth embodiment of the present invention.
Figure 15:
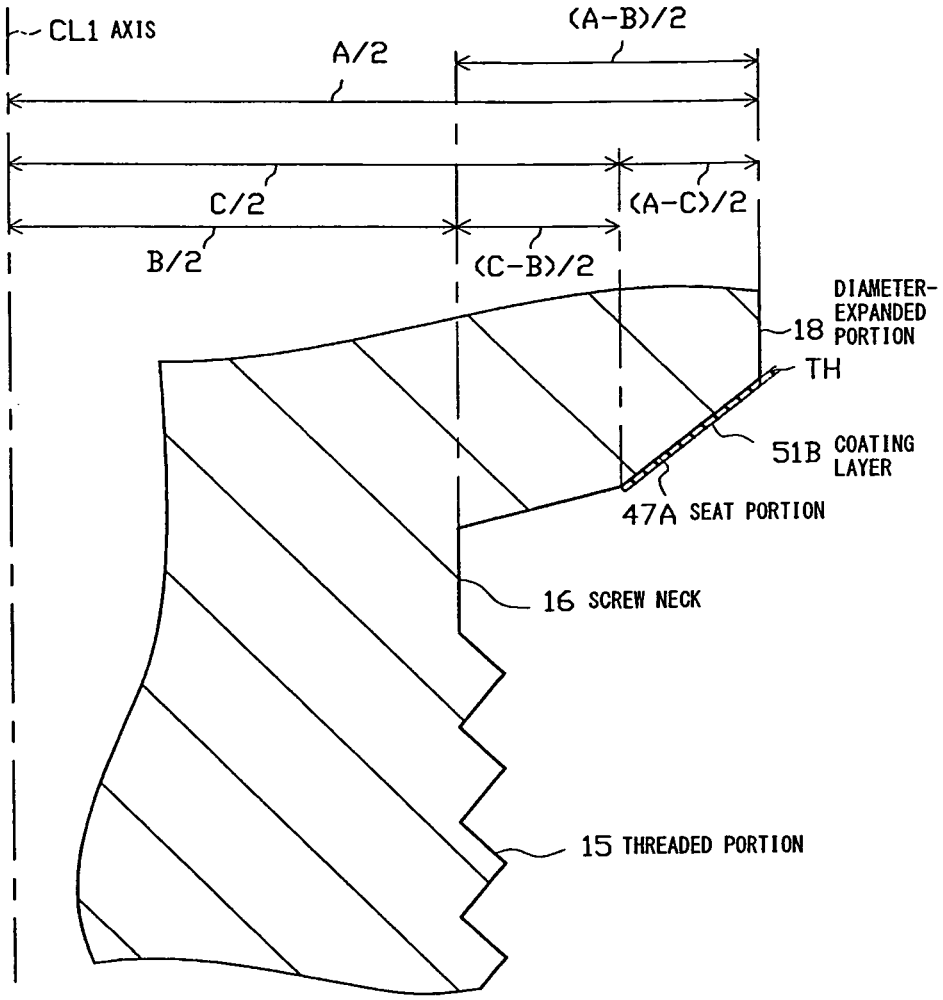
FIG. 15 is an enlarged partial sectional view for explaining the constitution of the coating layer, etc., in the fourth embodiment.

As compared with the third embodiment described above, a spark plug 1C of the present fourth embodiment is characterized particularly in that, as shown in FIGS. 14 and 15, a coating layer 51B (in FIG. 14, the dotted region) covers the surface of the seat portion 47A of the metallic shell 3.

Similar to the coating layer 51A in the second embodiment described above, the coating layer 51B is formed of a material (e.g., fluororesin) having a softening point of 200° C. or higher and a relatively low Vickers hardness of 100 Hv or less (e.g., 60 Hv or less). Therefore, the coating layer 51B is lower in hardness than the head 42. Also, the coating layer 51B has a surface roughness of 12.5 μm or less and a thickness TH of 5 μm to 300 μm inclusive.

Next, in order to verify actions and effects yielded by the third embodiment described above, spark plug samples were fabricated such that the threaded portions had a thread diameter of M12 or M10, the tool engagement portions had a size of HEX16 or HEX14, and the value of (C−B)/2 and the value of (A−C)/2 varied to thereby differ in the position of the boundary between the seat portion and the connection portion. The samples were subjected to the gastightness evaluation test mentioned above. In the gastightness evaluation test, evaluation was made on the following criteria: when air leakage is 0.1 ml/min or less, the evaluation is considered "excellent," indicating that excellent gastightness is implemented. When air leakage is 0.1 ml/min to less than 0.2 ml/min, the evaluation is considered "good," indicating that good gastightness is implemented. When air leakage is 0.2 ml/min or greater, the evaluation is considered "fair," indicating that gastightness is slightly inferior. The samples having a thread diameter of M12 had an (A−B) value of 3.6 mm, and the samples having a thread diameter of M10 had an (A−B) value of 3.5 mm. The samples had an angle (seat-portion angle) between the axis and the outline of the seat portion of 63°. The samples were mounted to a test bed with a predetermined tightening torque. Tables 1 and 2 show the results of the gastightness evaluation test. Table 1 shows the test results of the samples having a thread diameter of M12 and a HEX16 tool engagement portion. Table 2 shows the test results of the samples having a thread diameter of M10 and a HEX14 tool engagement portion. Tables 1 and 2 also show the area of the seat portion.

TABLE 1

| (C − B)/2 (mm) | (A − C)/2 (mm) | Area of seat portion ($mm^2$) | Evaluation |
|---|---|---|---|
| 0.00 | 1.80 | 149.4 | Fair |
| 0.15 | 1.65 | 138.4 | Fair |
| 0.30 | 1.50 | 127.2 | Good |
| 0.45 | 1.35 | 115.7 | Good |
| 0.60 | 1.20 | 103.9 | Good |
| 0.75 | 1.05 | 91.9 | Excellent |
| 0.90 | 0.90 | 79.5 | Good |
| 1.05 | 0.75 | 67.0 | Good |
| 1.20 | 0.60 | 54.1 | Fair |
| 1.35 | 0.45 | 41.0 | Fair |
| 1.50 | 0.30 | 27.6 | Fair |

TABLE 2

| (C − B)/2 (mm) | (A − C)/2 (mm) | Area of seat portion ($mm^2$) | Evaluation |
|---|---|---|---|
| 0.00 | 1.75 | 123.6 | Fair |
| 0.15 | 1.60 | 114.5 | Fair |
| 0.30 | 1.45 | 105.1 | Good |
| 0.45 | 1.30 | 95.4 | Good |
| 0.60 | 1.15 | 85.4 | Good |
| 0.75 | 1.00 | 75.2 | Excellent |
| 0.90 | 0.85 | 64.7 | Good |
| 1.05 | 0.70 | 53.9 | Good |

TABLE 2-continued

| (C − B)/2 (mm) | (A − C)/2 (mm) | Area of seat portion ($mm^2$) | Evaluation |
|---|---|---|---|
| 1.20 | 0.55 | 42.8 | Fair |
| 1.35 | 0.40 | 31.5 | Fair |
| 1.50 | 0.25 | 19.9 | Fair |

As is apparent from Tables 1 and 2, the samples having a (C−B)/2 value of 0.3 mm or greater and an (A−C)/2 value of 0.7 mm or greater implement good or excellent gastightness. Conceivably, this is for the following reason. Through employment of (C−B)/2≥0.3 mm, the area of the seat portion to come into close contact with the head can be reduced. Thus, even when the spark plug was mounted with the above-mentioned predetermined tightening torque, the seat portion could be brought in close contact with the test bed. Also, through employment of (A−C)/2≥0.7 mm, a sufficient area can be ensured for the seat portion. Thus, a sufficient seal could be ensured between the seat portion and the head.

Next, spark plug samples were fabricated such that the threaded portions had a thread diameter of M12 or M10, the tool engagement portions had a size of HEX16 or HEX14, and the seat-portion angle differed. The samples were subjected to the gastightness evaluation test mentioned above. Evaluation was made basically on the criteria similar to those mentioned above (e.g., when air leakage is 0.1 ml/min or less, evaluation is "excellent"). However, the evaluation was considered a "potential failure" (indicating that gastightness may be impaired when mounting and demounting the spark plug is repeated) when depression or a like damage is observed on the test bed after removal of the spark plug, even though excellent gastightness is implemented. Tables 3 and 4 shows the results of the gastightness evaluation test. The samples having a thread diameter of M12 had a (C−B)/2 value of 0.75 mm and an (A−C)/2 value of 1.05 mm. The samples having a thread diameter of M10 had a (C−B)/2 value of 0.75 mm and an (A−C)/2 value of 1.00 mm. Table 3 shows the test results of the samples having a thread diameter of M12 and a HEX16 tool engagement portion. Table 4 shows the test results of the samples having a thread diameter of M10 and a HEX14 tool engagement portion.

TABLE 3

| Seat-portion angle (°) | Area of seat portion ($mm^2$) | Evaluation |
|---|---|---|
| 35 | 159.6 | Potential failure |
| 40 | 140.3 | Potential failure |
| 45 | 125.4 | Potential failure |
| 50 | 113.6 | Potential failure |
| 55 | 103.9 | Potential failure |
| 60 | 96.0 | Excellent |
| 65 | 89.3 | Excellent |
| 70 | 83.7 | Excellent |
| 75 | 78.8 | Good |
| 80 | 74.7 | Good |
| 85 | 71.0 | Good |

TABLE 4

| Seat-portion angle (°) | Area of seat portion ($mm^2$) | Evaluation |
|---|---|---|
| 35 | 130.6 | Potential failure |
| 40 | 114.8 | Potential failure |
| 45 | 102.6 | Potential failure |

TABLE 4-continued

| Seat-portion angle (°) | Area of seat portion ($mm^2$) | Evaluation |
|---|---|---|
| 50 | 92.9 | Potential failure |
| 55 | 85.0 | Potential failure |
| 60 | 78.5 | Excellent |
| 65 | 73.1 | Excellent |
| 70 | 68.4 | Excellent |
| 75 | 64.5 | Good |
| 80 | 61.1 | Good |
| 85 | 58.1 | Good |

As is apparent from Tables 3 and 4, the samples can implement good gastightness. Particularly, the samples having a seat-portion angle of 60° to 70° inclusive can implement excellent gastightness without occurrence of damage on the test bed.

On the basis of the above test results, in view of ensuring good gastightness of a combustion chamber, employment of a (C−B)/2 value of 0.3 mm or greater and an (A−C)/2 value of 0.7 mm or greater is significant. Also, in view of implementing excellent gastightness, employment of a seat-portion angle of 60° to 70° inclusive is particularly significant.

The present invention is not limited to the above-described embodiments, but may be embodied, for example, as follows. Of course, application examples and modifications other than those described below are also possible.

(a) In the first embodiment described above, the intermediate of the metallic shell is manufactured by use of machining only, thereby imparting a hardness of 250 Hv or less (200 Hv or less) to the seat portion 17. However, a process for imparting a hardness of 250 Hv or less (200 Hv or less) to the seat portion 17 is not limited thereto. For example, while forging is used in combination with machining, the metallic shell 3 (seat portion 17) may be subjected to heat treatment for imparting a hardness of 250 Hv or less (200 Hv or less) to the seat portion 17. Also, a metal material used to form the metallic shell 3 may be modified (e.g., in the case of using carbon steel to form the metallic shell 3, carbon content may be reduced) for imparting a hardness of 250 Hv or less (200 Hv or less) to the seat portion 17. When a metal material used to form the metallic shell 3 is to be modified, it must be taken into account to ensure sufficient strength for the threaded portion 15, the crimp portion 20, etc.

(b) In the first embodiment described above, the entire seat portion 17 has a hardness of 250 Hv or less (200 Hv or less). However, at least a region of the seat portion 17 which comes into contact with the head 42 may have a hardness of 250 Hv or less (200 Hv or less).

(c) In the first and second embodiments described above, the seat portion 17 (47) is formed into a tapered shape. However, the shape of the seat portion 17 (47) is not limited thereto. For example, the seat portion 17 (47) may be formed orthogonally to the screw neck 16 and the diameter-expanded portion 18.

(d) In the third and fourth embodiments described above, the connection portion 17B is formed into such a shape as to be tapered frontward with respect to the direction of the axis CL1. However, the shape of the connection portion 17B is not limited thereto. For example, the connection portion 17B may be formed in such a manner as to extend toward the axis CL1 along a direction orthogonal to the axis CL1.

(e) In the third embodiment described above, the value of A−B is specified to be 1.6 mm or greater. However, the value of A−B is not limited thereto.

(f) In the third embodiment described above, the threaded portion 15 has a thread diameter of M12 or less, and the value of A−B is 1.6 mm or greater. However, the concept of the present invention that the connection portion 17B is provided is significant for the case where the threaded portion 15 has a far smaller thread diameter, and the value of A−B is far greater. Therefore, particularly through application of the technical concept of the present invention to a spark plug whose threaded portion 15 has a thread diameter of M10 or less and which has a value of A−B of 2.0 mm or greater, impairment in gastightness can be effectively prevented.

(g) In the second and fourth embodiments described above, the coating layers 51A and 51B have a Vickers hardness of 100 Hv or less. However, no particular limitation is imposed on the hardness of the coating layers 51A and 51B. The hardness of the coating layers 51A and 51B may exceed 100 Hv. When the hardness of the coating layers 51A and 51B is excessively low, the strength of the coating layers 51A and 51B may become insufficient. Therefore, preferably, the coating layers 51A and 51B have a hardness of 35 Hv or greater.

(h) In the second and fourth embodiments described above, fluororesin is used to form the coating layers 51A and 51B. However, no particular limitation is imposed on a material used to form the coating layers 51A and 51B so long as the material has a softening point of 200° C. or higher and lower in hardness than the head 42. Therefore, for example, heat-resistant rubber (e.g., fluororubber), another heat-resistant resin (e.g., polyimide resin, polyamide resin, or the like) may be used to form the coating layers 51A and 51B. Also, a metal material (e.g., zinc or the like) lower in hardness than the head 42 may be used to form the coating layer. However, in the case where zinc or the like is used to form the coating layer, preferably, the formed coating layer is greater in thickness (e.g., 10 μm or greater) than zinc plating or Ni plating which may be formed on substantially the entire surface of the metallic shell 3.

(i) In the above embodiments, no particular reference is made, but one or both of the center electrode 5 and the ground electrode 27 may have a noble metal tip. In this case, the spark discharge gap 33 is formed between one electrode 5 (27) and the noble metal tip provided on the other electrode 27 (5) or between the two noble metal tips provided on the respective electrodes 5 and 27.

(j) In the above embodiments, the ground electrode 27 is joined to the front end portion 26 of the metallic shell 3. However, the present invention is also applicable to the case where a portion of a metallic shell (or a portion of an end metal welded beforehand to the metallic shell) is cut to form a ground electrode (refer to, for example, Japanese Patent Application Laid-Open (kokai) No. 2006-236906).

(k) In the above embodiments, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

The invention claimed is:

1. A spark plug for an internal combustion engine, comprising:

a rod-like center electrode extending in a direction of an axis;

a substantially cylindrical insulator provided externally of an outer circumference of the center electrode;

a substantially cylindrical metallic shell provided externally of an outer circumference of the insulator; and a ground electrode extending from a front end portion of the metallic shell and defining, in cooperation with the center electrode, a gap between a distal end portion thereof and a front end portion of the center electrode;

the metallic shell having, on an outer circumferential surface thereof:

a threaded portion dimensioned to threadingly engage with a mounting hole of a head of an internal combustion engine, a screw neck located rearward of the threaded portion, a diameter-expanded portion located rearward of the screw neck and greater in diameter than the screw neck, and a seat portion located between the screw neck and the diameter-expanded portion, the seat portion is expanded in diameter rearward with respect to the direction of the axis CL1 and connectingly extends between the rear end of the screw neck and the front end of the diameter-expanded portion, and the seat portion being dimensioned to come into close contact with the head, when the threaded portion is threadingly engaged with the mounting hole of the head of the internal combustion engine, the spark plug being characterized in that the threaded portion has a thread diameter of M14, and the seat portion has a Vickers hardness of 250 Hv or less and has a hardness greater than a hardness of a portion of the head which comes into contact with the seat portion, the metallic shell further having a connection portion on an outer circumferential surface thereof, said connection portion connecting a front end of the seat portion and a rear end of the screw neck and forming with the axis, an angle greater than an angle between the seat portion and the axis as viewed on a section which contains the axis, and the following expressions and are satisfied:

$$(C-B)/2 \geq 0.3 \text{ mm} \quad (1) \text{ and}$$

$$(A-C)/2 \geq 0.7 \text{ mm} \quad (2),$$

where "A" represents an outside diameter of the diameter-expanded portion, "B" represents a smallest outside diameter of the screw neck, and "C" represents an outside diameter of a boundary between the seat portion and the connection portion.

2. A spark plug for an internal combustion engine, comprising:

a rod-like center electrode extending in a direction of an axis;

a substantially cylindrical insulator provided externally of an outer circumference of the center electrode;

a substantially cylindrical metallic shell provided externally of an outer circumference of the insulator; and a ground electrode extending from a front end portion of the metallic shell and defining, in cooperation with the center electrode, a gap between a distal end portion thereof and a front end portion of the center electrode;

the metallic shell having, on an outer circumferential surface thereof:

a threaded portion dimensioned to threadingly engage with a mounting hole of a head of an internal combustion engine, a screw neck located rearward of the threaded portion, a diameter-expanded portion located rearward of the screw neck and greater in diameter than the screw neck, and a seat portion located between the screw neck and the diameter-expanded portion, the seat portion is expanded in diameter rearward with respect to the direction of the axis CL1 and connectingly extends between the rear end of the screw neck and the front end of the diameter-expanded portion, and the seat portion being dimensioned to come into close contact with the head, when the threaded portion is threadingly engaged with the mounting hole of the head of the internal combustion engine, the spark plug being characterized in that the threaded portion has a thread diameter of M12 or less, and the seat portion has a Vickers hardness of 200 Hv or less, the metallic shell further having a connection portion on an outer circumferential surface thereof, said connection portion connecting a front end of the seat portion and a rear end of the screw neck and forming with the axis, an angle greater than an angle between the seat portion and the axis as viewed on a section which contains the axis, and the following expressions and are satisfied:

$$(C-B)/2 \geq 0.3 \text{ mm} \quad (1) \text{ and}$$

$$(A-C)/2 \geq 0.7 \text{ mm} \quad (2),$$

where "A" represents an outside diameter of the diameter-expanded portion, "B" represents a smallest outside diameter of the screw neck, and "C" represents an outside diameter of a boundary between the seat portion and the connection portion.

3. A spark plug for an internal combustion engine according to claim 1 or 2, wherein the seat portion has a ten-point height of irregularities of 12.5 μm or less as measured on a surface thereof which comes into contact with the head.

4. A spark plug for an internal combustion engine according to claim 1 or 2, wherein the angle between the seat portion and the axis as viewed on the section which contains the axis is 60 degrees to 70 degrees inclusive.

5. A spark plug for an internal combustion engine, comprising:

a rod-like center electrode extending in a direction of an axis;

a substantially cylindrical insulator provided externally of an outer circumference of the center electrode;

a substantially cylindrical metallic shell provided externally of an outer circumference of the insulator; and a ground electrode extending from a front end portion of the metallic shell and defining, in cooperation with the center electrode, a gap between a distal end portion thereof and a front end portion of the center electrode;

the metallic shell having, on an outer circumferential surface thereof:

a threaded portion dimensioned to threadingly engage with a mounting hole of a head of an internal combustion engine, a screw neck located rearward of the threaded portion, a diameter-expanded portion located rearward of the screw neck and having a diameter greater than a diameter of the screw neck, and a seat portion located between the screw neck and the diameter-expanded portion, and the seat portion is expanded in diameter rearward with respect to the direction of the axis CL1 and connectingly extends between the rear end of the screw neck and the front end of the diameter-expanded portion, the spark plug being characterized in that a coating layer covers a surface of the seat portion, said coating disposed on said seat portion to come in close contact with the head when the threaded portion is threadingly engaged with the mounting hole of the head of an internal combustion engine, and the coating layer is formed of a material including heat-resistant rubber or heat-resistant resin and having a softening point of 200° C. or higher and a hardness that is lower than the hardness of a portion of the head which comes into contact with the coating layer, the metallic shell further having a connection portion on an outer circumferential surface thereof, said connection portion connecting a front end of the seat portion and a rear end of the screw neck and forming with the axis, an angle greater than an angle between the seat portion and the axis as viewed on a section which contains the axis, and the following expressions and are satisfied:

$$(C-B)/2 \geq 0.3 \text{ mm} \quad (1) \text{ and}$$

$$(A-C)/2 \geq 0.7 \text{ mm} \quad (2),$$

where "A" represents an outside diameter of the diameter-expanded portion, "B" represents a smallest outside diameter of the screw neck, and "C" represents an outside diameter of a boundary between the seat portion and the connection portion.

6. A spark plug for an internal combustion engine according to claim 5, wherein the coating layer has a Vickers hardness of 100 Hv or less and has a ten-point height of irregularities of 12.5 μm or less as measured on a surface thereof which comes into contact with the head.

7. A spark plug for an internal combustion engine according to claim 5 or 6, wherein the coating layer has a thickness of 5 μm to 300 μm inclusive.

* * * * *